US005669277A

United States Patent [19]

Perrone

[11] Patent Number: 5,669,277

[45] Date of Patent: Sep. 23, 1997

[54] METHOD OF DIE-PUNCHING HOLES IN PAPER

[76] Inventor: Sal Perrone, 129 Forest Ave., Shirley, N.Y. 11967

[21] Appl. No.: 10,831

[22] Filed: Jan. 29, 1993

[51] Int. Cl.[6] ..... B26D 1/56

[52] U.S. Cl. ..... 83/37; 83/345; 83/553; 83/698.41

[58] Field of Search ..... 83/345, 698, 699, 83/553, 559, 592, 640, 641, 13, 37

[56] References Cited

U.S. PATENT DOCUMENTS

| | | | |
|---|---|---|---|
| 1,649,635 | 11/1927 | Willard | 83/345 |
| 3,064,513 | 11/1962 | Hershey | 83/345 |
| 3,956,956 | 5/1976 | Bertholf | 83/345 |
| 4,036,088 | 7/1977 | Ruskin | 83/698 X |
| 4,343,215 | 8/1982 | Fuchs | 83/698 X |
| 4,594,926 | 6/1986 | Propheter | 83/698 X |

*Primary Examiner*—Kenneth E. Peterson
*Attorney, Agent, or Firm*—Myron Amer, P.C.

[57] ABSTRACT

In the operation of hole punching apparatus, a method of changing punched hole formats in paper, for loose leaf binder pages or the like, using cooperating rollers for the male punches and female die members having the various formats embodied therein, so that after the male punches are projected into the female die members for any one selected format for achieving alignment or registration therebetween, this alignment for any other subsequent format does not have to be repeated and only the punches placed in mounting openings on the male punch roller for the subsequent format; the female die members being no problem because they do not, without a cooperating male punch, cause punched holes in the paper.

1 Claim, 4 Drawing Sheets

METHOD OF DIE-PUNCHING HOLES IN PAPER

The present invention relates generally to sheet punching mechanisms, as described and illustrated for example in the patent to Hershey issued as U.S. Pat. No. 3,064,513 on Nov. 20, 1962 and typically used in producing looseleaf binder pages, and more particularly to improvements to such a mechanism which contributes to a noteworthy operational mode that significantly minimizes set-up time and effort in changing from one to another punched hole pattern for the page.

EXAMPLES OF THE PRIOR ART

In the aforementioned Hershey patent, which is one of many exemplary prior patents, plural rings supported on two separate shafts, one for the male punches and the other for the female dies, are aligned and in practice hole-punch a paper strip fed therebetween to produce a punched hole pattern, which might be a side three-hole arrangement. Switching to a side four-hole or other multiple-hole pattern, necessitates mounting additional rings on the supporting shafts, and duplicating a tedious aligning procedure for the cooperating male and female hole-punching dies embodied in the rings.

In U.S. Pat. No. 1,649,635 issued to Willard on Nov. 15, 1927 for "Perforating Device", cooperating rollers are substituted for the prior art rings, and this facilitates the provision of punched holes widthwise of the paper strip fed therebetween, in that shifting of rings axially along support shafts is obviated. Shifting, however, is not entirely eliminated in Willard, since the hole-punching male and female dies are slidably disposed in slots in their respective rollers and must be shifted into aligning relationship preparatory to hole-punching service. Thus, shifting from a side three-hole pattern to say, for example, a seven-hole pattern, may not require the aligning of rings as taught in Hershey, but it still requires tedious aligning of the hole-punching dies along the slots noted. Even more significant, relocating the punched holes from the side to the top edge of the page is only possible in Willard by changing the rollers.

Broadly, it is an object of the present invention to provide an operating mode for binder looseleaf page production overcoming the foregoing and other shortcomings of the prior art.

More particularly, it is an object to provide a hole-punching device which once set-up to produce a selected hole punch arrangement is readily capable, with minimum set-up effort and time, to produce another hole punch arrangement from any one of the numerous patterns currently commercially in use for ring binder looseleaf pages.

In a preferred embodiment, the within hole-punching or perforating mechanism uses rollers instead of rings and has for selection any group of twenty-three possible locations for the punched holes, including along the top edge as well as the side of the page, characterized by minimum set-up time and effort, all as will be explained subsequently in greater detail.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
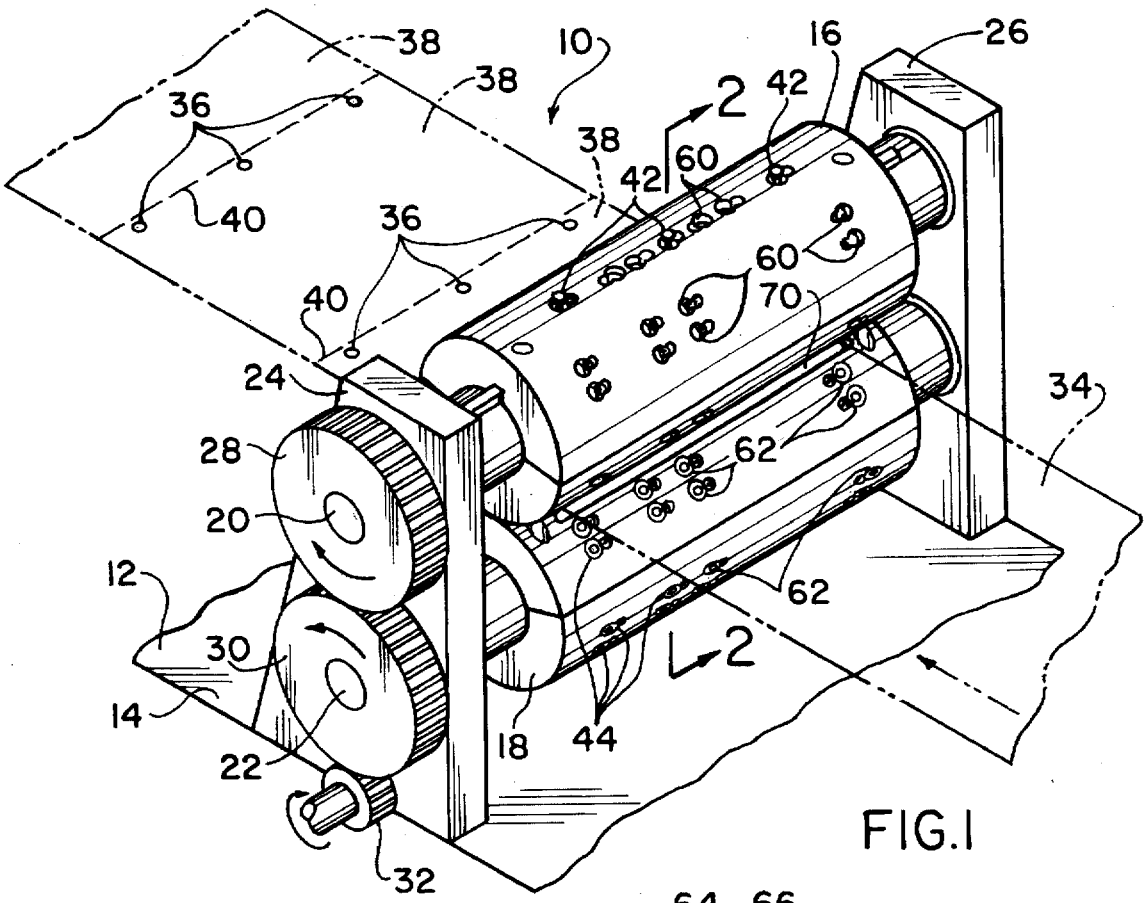
FIG. 1 is a perspective view of a hole punching apparatus of the present invention.
Figure 5:
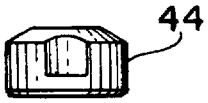
FIG. 5 is a front elevational view of the die member of FIG. 4.
Figure 5A:
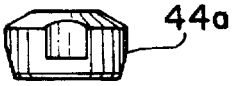
Figure 8:
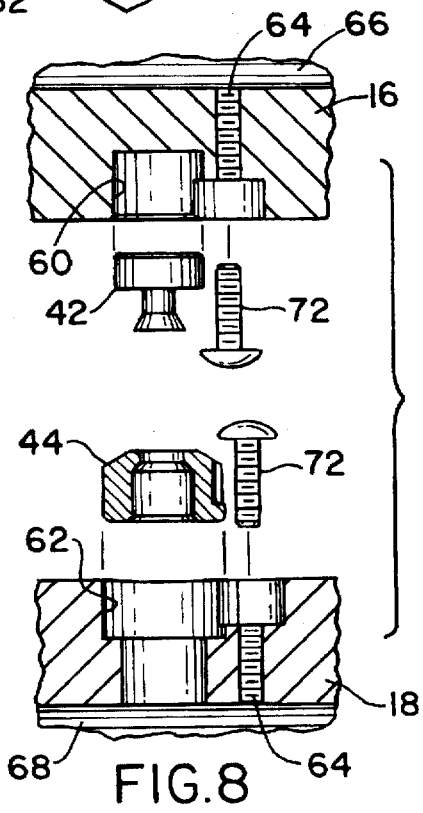
Figure 6:
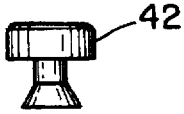
Figure 7:
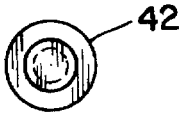
Figure 2:
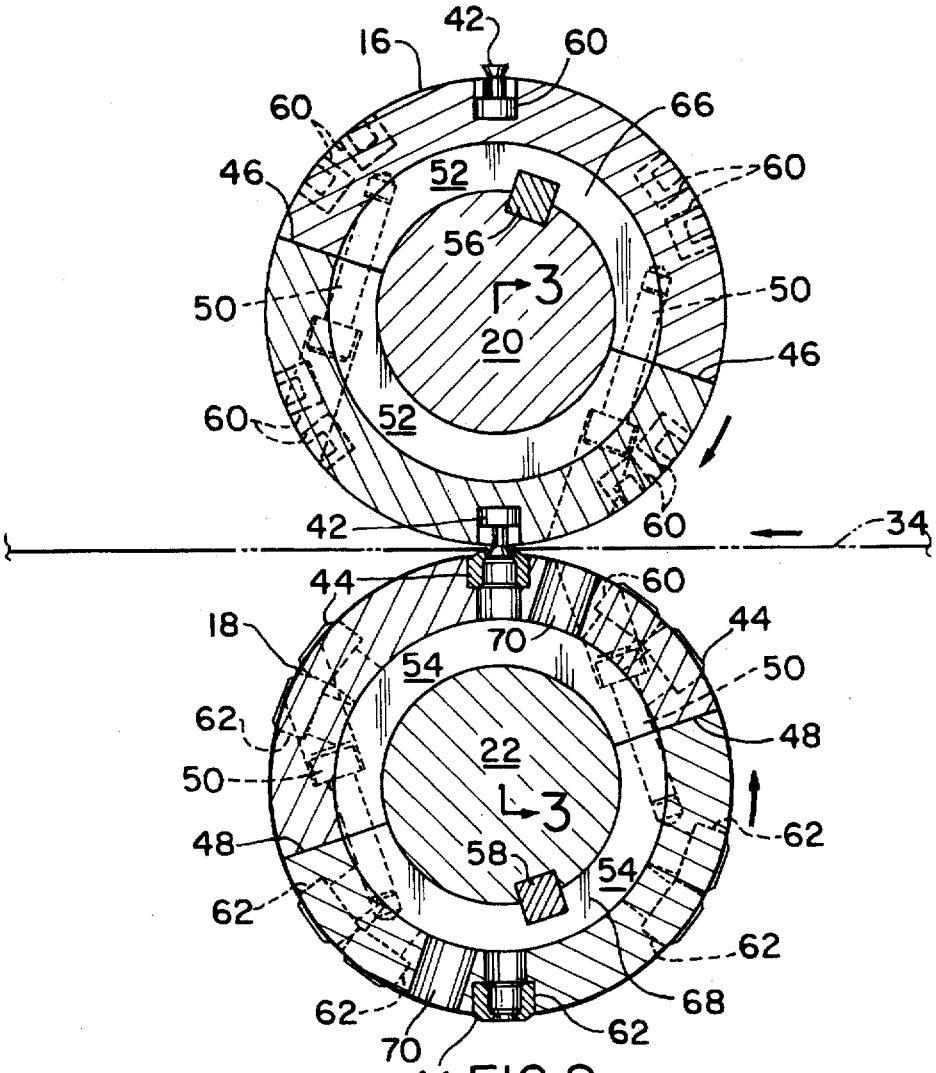
FIG. 2 is a cross sectional view taken along line 2—2 of FIG. 1.
Figure 3:
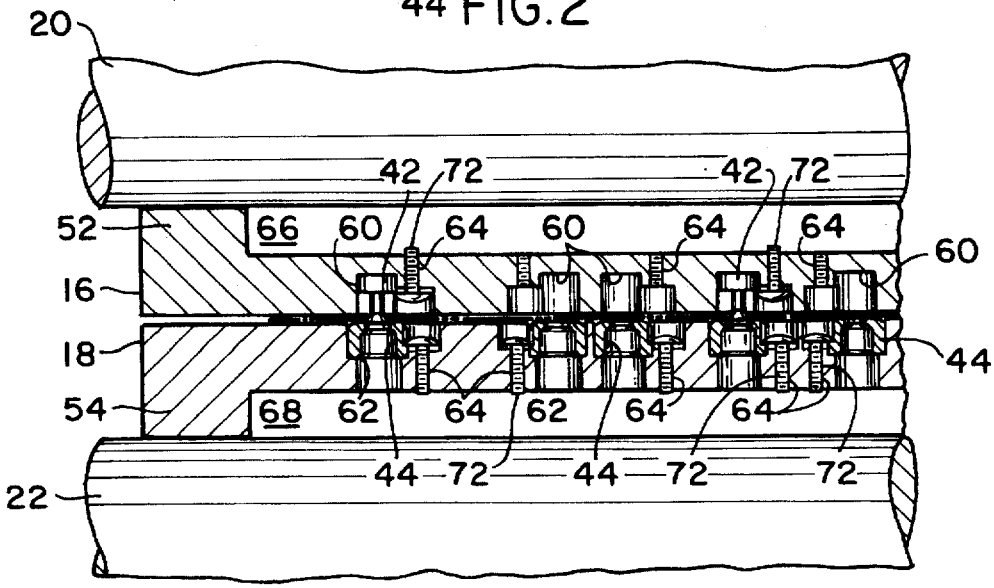
FIG. 3 is a cross sectional view taken along line 3—3 of FIG. 2.
Figure 9:
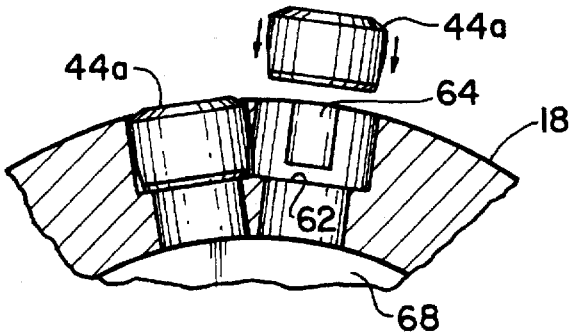

FIG. 5*a* is an elevational view similar to FIG. 5, but of a modified die member;

FIG. 6 is an isolated front elevational view of a male punch used in the apparatus of FIG. 1;

FIG. 7 is a bottom view of the punch of FIG. 6;

FIG. 8 is a partial view similar to FIG. 3, but showing the roller components of the apparatus of FIG. 1 in spaced apart relation and with the male and female die members in disassembled relation therefrom;

FIG. 9 is a partial view similar to FIG. 2 showing details of the mounting of the die member of FIG. 5*a;*

Figure 10:
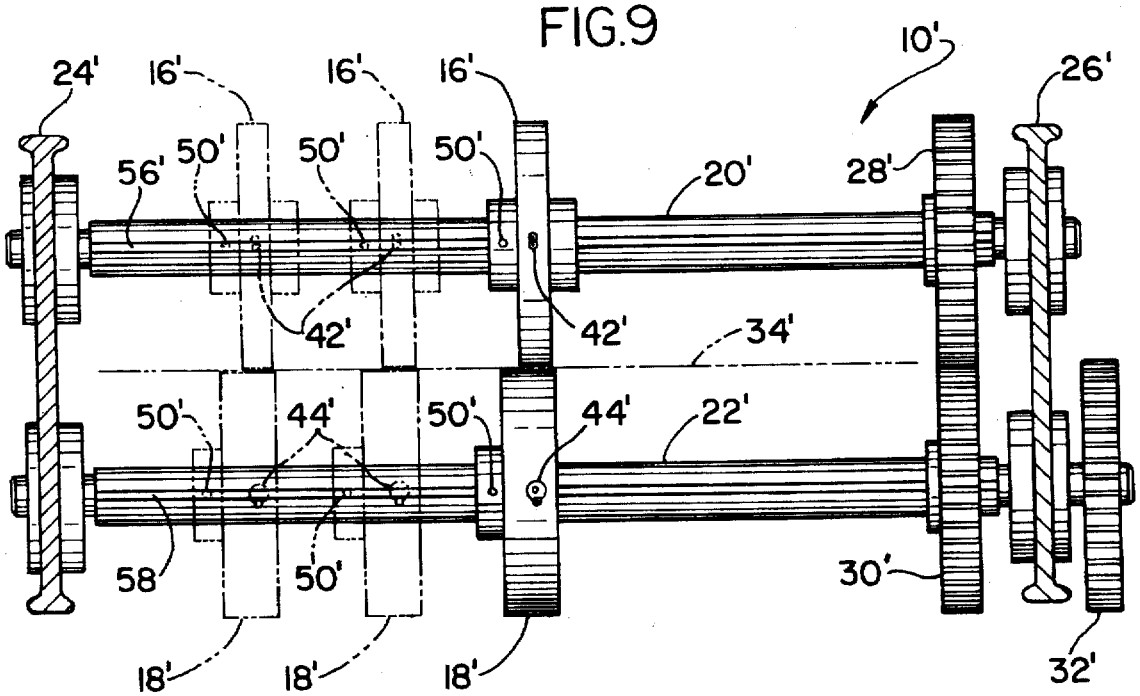
FIG.10 PRIOR ART
Figure 11:
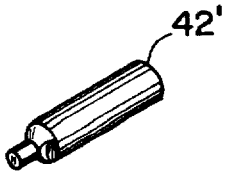
FIG.11 PRIOR ART
Figure 12:
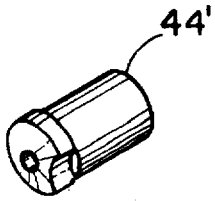
FIG.12 PRIOR ART

FIG. 10 is a front elevational view of a prior art hole punching apparatus;

FIG. 11 is an isolated perspective view of a male punch used in the apparatus of FIG. 10; and FIG. 12 is an isolated perspective view of a female die member used in the apparatus of FIG. 10.

Shown in the drawings is a mechanism for the manufacture of pages for a looseleaf binder which has the adjustability to accommodate the different versions that are typically sold commercially, namely, a pattern of three punched holes, four holes, and progressively up to possibly seven holes out of a theoretically possibility of 23 hole locations, all as will be explained in detail subsequently.

Referring to FIG. 1, there is shown an elongated 11" wide paper strip 34 delineated into pages 38 by lines of perforations 40 spaced 8½" apart lengthwise of the strip 34 and having three punched holes 36, such that when subsequently separated along the lines of perforations 40 there results the familiar 8½"×11" looseleaf sheet for a three ring looseleaf binder.

The crux of the present invention is to construct the die punching apparatus 10 and to operate this apparatus so that it also can readily produce four-hole, five-hole, and possibly up to seven-hole looseleaf pages, with a minimum effort of set-up time and difficulty in changing from three-hole to an increased-hole pattern of holes 36. This requires correspondingly minimizing the effort and need to align the male and female die members of the selected hole pattern.

Figure 1A:
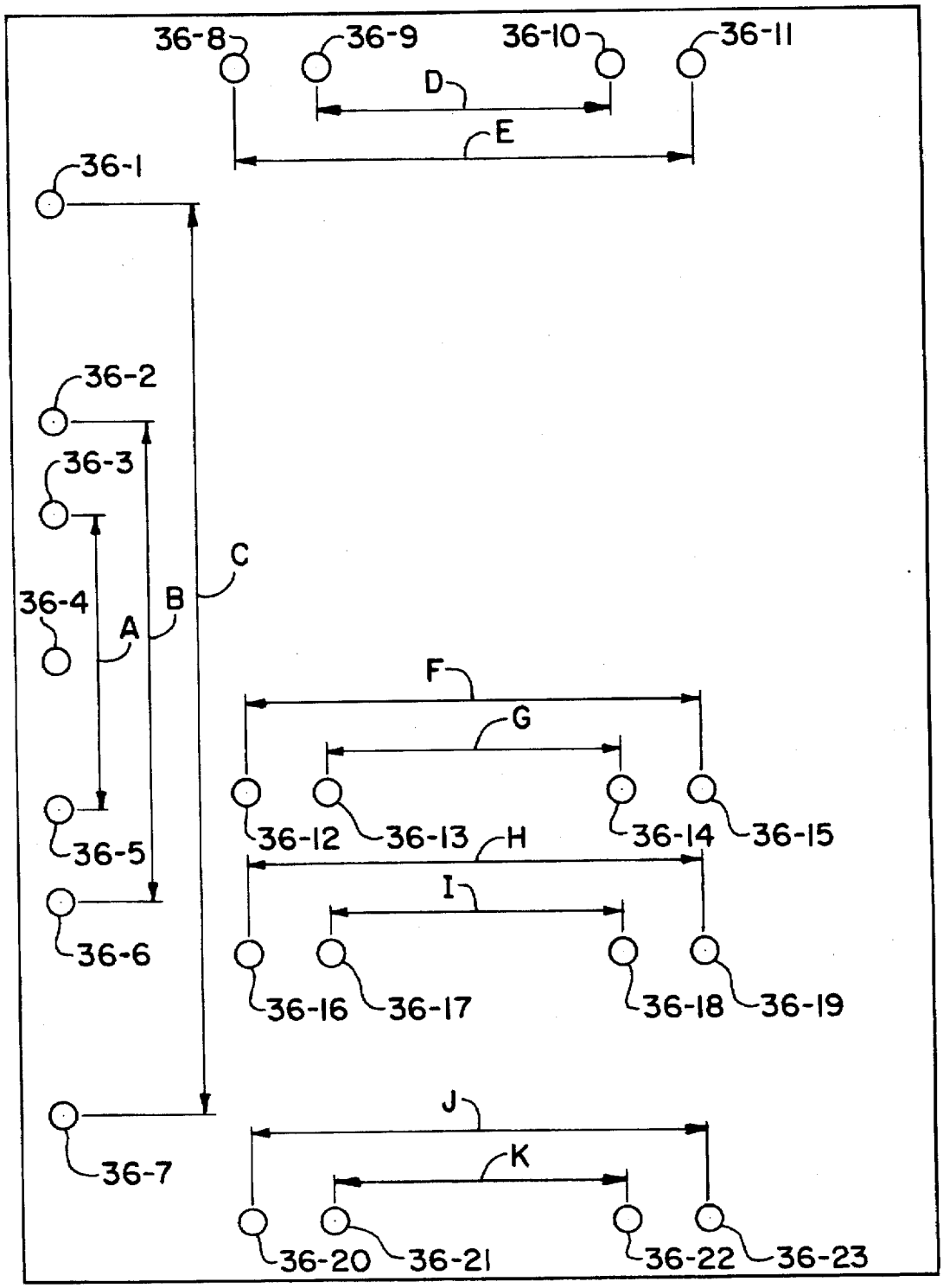
FIG. 1A is a layout of the various patterns of punched hole locations that can be obtained using the apparatus of FIG. 1.

More particularly, and as best understood from a consideration of FIG. 1A, the hole-punching apparatus of FIG. 1 is manufactured so as to have the capacity of providing looseleaf pages with a pattern of punched holes at locations that can be selected from the twenty-three locations 36-1 through 23, respectively. To this end, it will be understood that the rollers 16 and 18 which mount the cooperating hole-punching die members 42 and 44 respectively have die-mounting openings 60 and 62 at locations thereabout corresponding to the locations 36-1 through 23 to produce a selected hole pattern. Thus, as shown in FIG. 1, looseleaf page 38 has a side three-hole pattern at locations 36-1, 36-4 and 36-7 to fit a conventional three-hole looseleaf binder. With a minimum of set-up time and effort, however, using the hole-punching apparatus of FIG. 1 according to the within inventive method, a top two-hole pattern can be produced in the pages with punched holes at locations 36-8 and 36-11, or a four-hole pattern with punched holes at 36-8, 36-9, 36-10 and 36-11. Similarly, it is possible to switch to other multiple-hole patterns by merely mounting the cooperating hole-punching die members in the appropriate locations 36-1 through 23 to provide the desired hole pattern.

To implement the changing from one hole pattern to another without duplicating tedious set-up time and effort, it is important to drill the holes 60 and 62 provided to receive the hole-punching members 42 and 44, respectively, in a spaced relationship about the peripheral surfaces of the rollers 16 and 18 to provide the hole locations as noted in FIG. 1A. For completeness sake, it is noted that the following recommended dimensions are those measured center-to-center of the holes as follows: Dimension A of 2¾"; dimension B of 4¼" or 4½"; dimension C of 8½"; dimension D of 2¾"; dimension E of 4¼"; dimension F of 4¼"; dimension G of 2¾"; dimension H of 4¼"; dimension I of 2¾"; dimension J of 4¼"; and dimension K of 2¾".

At this point in the description it is helpful to note what is done in the prior art to produce different punched hole looseleaf pages, since it demonstrates the prior art shortcoming in the handling of the alignment of the cooperating male and female die members.

Shown in prior art FIG. 10 is the punching station 10' as typically used on a printing press. One or more punch rings 16' with cooperating rings 18' are keyed to respective shafts 20', 22' which are appropriately journaled for rotation in stanchions 24', 26'. The support shafts 16', 18' are rotatably driven counterclockwise by respective gears 28', 30'. A drive gear 32' will be understood to be powered by an appropriate drive motor. A paper substrate in strip form shown in phantom perspective and designated 34' is fed between the hole-punching rings 16', 18' and at a speed synchronized to the rotational speed of the shafts 20', 22', all in a manner which is well understood. Each ring 16' is machined to receive one or more punches 42', as shown in FIG. 11, while each cooperating ring 18' is likewise appropriately machined to receive a die member 44', as illustrated in FIG. 12. Each ring 16' has a hub which is fitted with an anchor screw 50' against the key 56' on shaft 20'. Likewise, each ring 18' also has a hub which is fitted with an anchor screw 50' against a key 58' on shaft 22'.

In the prior art arrangement as just described, it can be readily appreciated that it is necessary in changing the locations of the punched holes to disassemble the shafts 20', 22' from the stanchions 24', 26'. This in an obvious manner increases the setup time and effort for hole-punching the paper substrate 34'. Additionally, and even more significant, it is also necessary to perform a lateral alignment of each cooperating upper and lower ring 16' and 18'. Because each ring has a keyway present in its hub, extremely accurate radial machining is required for the positioning of punches 42' and dies 44' in addition to a rather complex self aligning feature within the dies 44' which is not shown but which nevertheless is well understood. Lastly, it is also required that a large inventory of rings be maintained to accommodate the many hole patterns that may be desired for the customers of the looseleaf pages that are being produced. In contrast to this, and as will now be explained in detail, once the rollers 16 and 18 of FIG. 1 are aligned and set up for a hole-punching operation for any particular hole pattern, to switch to another hole pattern does not require any duplication of any set-up time and effort. Additionally, there is no need for an inventory of the hole-punching rings of the prior art since all of the possible desired hole patterns are embodied in the manner in which the peripheral surfaces of the rollers 16 and 18 have been machined.

Referring now again to FIG. 1, it will be understood that this depicts the mechanism at the hole-punching station, generally designated 10 of a printing press or the like. That is, shown in FIG. 1 will be understood to be a chassis 12 of a printing press 14, which otherwise is not shown. At station 10 there is provided an upper punch roller 16 and a lower die roller 18, both of which are keyed to respective shafts 20, 22 which in turn are mounted for rotation in suitable bearings (not shown) which are secured in stanchions 24, 26. Rollers 16 and 18 are driven in counter directions relative to each other by respective gears 28, 30. A drive pinion 32 delivers power from a drive motor (not shown).

Typically, a printed paper substrate in an elongate strip, shown in phantom perspective and designated 34, is fed between the rollers 16, 18 at a velocity V that is synchronized to the tangential rotational speed of the rollers. As strip 34 passes through the hole-punching station 10 it is punched or perforated with a predetermined pattern of holes 36 at the location shown on a typically commercially sized sheet which functions as a looseleaf page 38, when the page is separated from the strip at lines of perforation 40.

Thus, shown in FIG. 1 is a typical example of an 11" wide strip 34 being punched with a three hole pattern 36 every 8½" along its length. Rollers 16, 18 which have an effective circumference of 17", carry two sets each of diametrically opposed punches 42 and dies 44 respectively, that cooperate to produce the hole pattern 36 shown in FIG. 1. Strip 34 is then separated or cut along the perforation lines 40 to provide the familiar three hole 8½"×11" looseleaf page.

Each of the cylinders or rollers 16 and 18, as best shown in FIG. 2, are made in two halves about respective parting lines 46, 48, and are fastened to each other by a bolt 50. Preferably, the rollers are made to have a circumference dimension of 2×8½", 2×11" or 2×14", and a punch and die pattern as alluded to and described in connection with FIG. 1A, which has the capacity of providing most of the standard formats required commercially for the locations of the punched holes. The length of the rollers are chosen to be at least as long as the width of the paper strip 34. Each of the rollers or cylinders 16, 18 has an internal flange respectively designated 52, 54 at each of its ends. Flanges 52, 54 are shaped to mate with respective keys 56, 58 as are the shafts 20, 22. Flanges 52, 54 thus make provision for an annular space 66, 68 between respective shafts 20, 22 and rollers 16, 18, which in the case of the latter, functions as a hole-punching nip. Roller 18 is provided with a least one elongated slot 70 to receive the circular hole-sized paper that is removed from the strip 34 and accumulates within an annular space 68.

Figure 4:
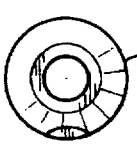
FIG. 4 is an isolated plan view of a female die member used in the apparatus of FIG. 1.

As best shown in FIGS. 1, 2 and 3, roller 16 in accordance with the present invention, is machined with a pattern of punch seats 60, while roller 18 is likewise machined with a corresponding pattern of die seats 62, which correspond to the locations 36-1 through 23 of FIG. 1A. Each of the seats 60, 62 is made with an offset countersunk tapped hole 64 to receive a punch or die holding screw 76, for retaining the hole-punching members in a manner which is well understood. For completeness sake, it is mentioned and to be noted, particularly in FIGS. 4 and 5, that dies 44 are received in a hardened and ground condition ready for use, a full set of which can be installed in all snugly fitting die seats 62 and secured with the screws 76. In similar fashion, punches 42 are also secured with screws 76 in holes 60 in a well understood manner (see FIGS. 6 and 7). Referring to FIGS.

1A and 5, it will be noted that in punched hole locations that are close to each other, such as exemplified by hole 36-8 and 36-9, to obviate interference it is recommended that the circumference of the dies 44 be ground at an angle on the "sides" at 90 degrees to the anchor set screw thus forming the altered shape designated 44A in FIG. 5A.

Underlying the present invention is of course the providing of the rollers 16 and 18 so that they can receive hole-punching members 42 and 44 at any of a group of selected locations from the theoretical 23 locations 36-1 through 23 of FIG. 1A. Assume the side 3-hole pattern of page 38 of FIG. 1 has been selected. During the initial setup, rollers 16, 18 are brought into lateral alignment by loosening bolts 50 in one or both rollers 16, 18. Radially opposed alignment of rollers 16, 18 is readily accomplished by allowing one or both gears 28, 30 to be "loose" on their respective shafts 20, 22. By manually rotating either one or both of the rollers 16 and 18, it is thus possible to readily bring into alignment the cooperating hole-punching members that will produce the side 3-hole pattern referred to in connection with FIG. 1. Once this alignment is achieved, gears 28, 30 are secured against rotation to their support shafts 20, 22 in a conventional and well understood manner.

A noteworthy consequence that is achieved once the alignment noted is completed is that all punch seats 60 are in alignment with the respective dies 44, already mounted in the seats 62 provided for the dies 44. This, of course, is possible since the dies 44 are "female" and as such do not project into the hole-punching nip between the rollers 16 and 18 and therefore do not interfere with the feeding of the strip 34 through the hole-punching nip. When, however, a male punch 42 is inserted in its assigned punch seat 60 there occurs in a well understood manner a hole-punching operation effectuated by the interaction of a cooperating punch 42 and die 44. When a new hole pattern is selected for a production run, the punches 42 which are not a part of this hole pattern which may be in place on the roller 16 are merely removed and punches 42 placed in cooperating seats 60 which will provide the locations necessary for the selected hole pattern. As already noted, the within hole-punching mechanism and its method of use as described herein obviates any tedious set-up time and effort previously required, for example, in the use of the hole-punching apparatus depicted in prior art FIG. 10.

While for illustrative purposes the invention has been described in connection with the production of looseleaf binder pages, it is to be understood that another contemplated use is in connection with the production of business forms having punched holes in differing numbers and in different arrangements. More particularly, while the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of using cooperating male and female die punches to die punch holes in an elongated paper substrate strip of a width size of at least 8½ inches at selected locations which in number are less than a selected larger number of available locations, said method comprising the steps of:

(a) locating in a rotatable upper roller of a width as measured along a rotational axis of said roller of at least a selected extent plural male punch die-receiving mounting means;

(b) locating in a rotatable lower roller of a width as measured along a rotational axis of said roller of at least a selected extent plural female punch die-receiving mounting means;

(c) selecting as said selected extents of said rotatable upper roller and rotatable lower roller said width of said elongated paper substrate strip to contribute to longitudinal direction tracking of said elongated paper substrate strip in an interposed position therebetween;

(d) mounting said upper and lower rollers in adjacent relation to form a hole-punching nip therebetween parallel to a rotating axis of said rollers;

(e) disposing respectively in said die-receiving mounting means at a first selected plural location and in a corresponding number male punch dies in said upper roller and an equal number of cooperating female punch dies in said lower roller;

(f) rotating manually said upper and lower rollers at different angular velocities until said male punches project into said cooperating female punches;

(g) confining said upper and lower rollers to the same angular velocity so as to provide said established alignment of said male and female die punches in each rotational traverse thereof;

(h) punching holes in an elongated paper substrate strip of a width size of at least 8½ inches at said first selected plural locations and number; and (i) relocating said male and female die punches in a second location different from said first location in said upper and lower rollers while maintaining said simultaneous rotational mode of said rollers;

whereby the alignment between said male and female die punches previously established in said first selection is automatically established also for said relocated second location of said male and female die members.

* * * * *